US008904988B1

(12) United States Patent
Bryde et al.

(10) Patent No.: US 8,904,988 B1
(45) Date of Patent: Dec. 9, 2014

(54) VERTICALLY DISPOSED OIL PAN BAFFLE

(71) Applicant: GM Global Technology Operations LLC, Detroit, MI (US)

(72) Inventors: Steven G. Bryde, Davisburg, MI (US); Michael B. Fleck, Royal Oak, MI (US); Karl R. Gilgenbach, Rochester Hills, MI (US); Michael D. Pepperman, Commerce Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/943,394

(22) Filed: Jul. 16, 2013

(51) Int. Cl.
*F01M 1/02* (2006.01)
*F01M 11/06* (2006.01)

(52) U.S. Cl.
CPC ..... *F01M 11/064* (2013.01)
USPC ..... 123/195 C; 123/196 R

(58) Field of Classification Search
CPC ..... F01M 11/0004; F01M 2011/0033; F01M 2011/0041; F01M 11/064; F01M 11/06; F16H 57/0423
USPC ..... 123/195 C, 196 R
See application file for complete search history.

(56) References Cited

U.S. PATENT DOCUMENTS

| | | | | |
|---|---|---|---|---|
| 4,449,493 | A * | 5/1984 | Kopec et al. | 123/196 R |
| 6,845,743 | B1 * | 1/2005 | Bishop | 123/196 R |
| 7,748,500 | B2 | 7/2010 | Nagano et al. | |
| 7,938,095 | B2 | 5/2011 | Jessberger et al. | |
| 8,069,834 | B2 * | 12/2011 | Riedel et al. | 123/196 R |
| 2012/0210971 | A1 | 8/2012 | Noguchi et al. | |

* cited by examiner

*Primary Examiner* — Noah Kamen
(74) *Attorney, Agent, or Firm* — Cantor Colburn LLP

(57) ABSTRACT

A vertically disposed oil pan baffle includes a body having first and second opposing side walls joined by a third wall, and an opposing fourth wall. Each of the first and second side walls is configured to conform with first and second internal surfaces of an oil pan. A metering opening is formed in one of the third and fourth walls. The metering opening is configured and disposed to control a rate of flow of oil through the vertically disposed oil pan baffle.

18 Claims, 6 Drawing Sheets

VERTICALLY DISPOSED OIL PAN BAFFLE

FIELD OF THE INVENTION

The subject invention relates to the art of motor vehicles and, more particularly, to a vertically disposed oil pan baffle for a motor vehicle engine.

BACKGROUND

Many motor vehicles rely on some form of lubricant to reduce friction between adjacent moving surfaces. In most cases, a motor vehicle engine includes an engine block that includes cylinders, pistons, and one or more cylinder heads that may support valves. An oil pan is generally mounted to a lower portion of the engine block. The oil pan collects lubricant or oil passing downward through the cylinder heads and engine block. The engine often includes an oil pump having an inlet provided in the oil pan. The oil pump urges the oil from the oil pan back through the engine block, often times to the cylinder heads, to provide continuous lubrication. In many cases, the oil pan is shaped to force the oil to collect near the inlet.

In some instances, oil may move away from the inlet. Vehicle accelerations could generate forces that cause the oil to move away from the inlet. Accelerations may arise from increases in vehicle speed, changes of direction, such as driving through a curve or making a right or left turn, and the like. When oil moves away from the inlet, supply to the oil pump may be interrupted. In such cases, continuity of the oil flow may also be interrupted. Accordingly, it is desirable to provide a baffle in the oil pan to limit oil moving away from the inlet to ensure continuity of oil delivery to the motor vehicle engine.

SUMMARY OF THE INVENTION

In accordance with an exemplary embodiment, a vertically disposed oil pan baffle includes a body having first and second opposing side walls joined by a third wall, and an opposing fourth wall. Each of the first and second side walls is configured to generally conform to first and second internal surfaces of an oil pan. A metering opening is formed in one of the third and fourth walls. The metering opening is configured and disposed to control a rate of flow of oil through the vertically disposed oil pan baffle.

In accordance with another exemplary embodiment, a motor vehicle engine includes an engine block having a bottom end including a peripheral mounting flange. An oil deflector is mounted to the bottom end and surrounded by the peripheral mounting flange. An oil pan is mounted to the engine block through the peripheral mounting flange. The oil pan includes a bottom wall, and first, second, third and fourth side wall portions that define a sump portion and a collection portion. Each of the first and second side walls include corresponding first and second internal surfaces. A vertically disposed oil pan baffle is positioned in the oil pan dividing the sump portion and the collection portion. The vertically disposed oil pan baffle includes a body having first and second opposing side walls joined by a third wall and an opposing fourth wall. Each of the first and second side walls is arranged adjacent to, and configured to, conform to the first and second internal surfaces of the first and second side wall portions of the oil pan. A metering opening is formed in one of the third and fourth walls. The metering opening is configured and disposed to control a rate of flow of oil from the collection portion to the sump portion through the vertically disposed oil pan baffle.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which.

DESCRIPTION OF THE EMBODIMENTS

Figure 1:
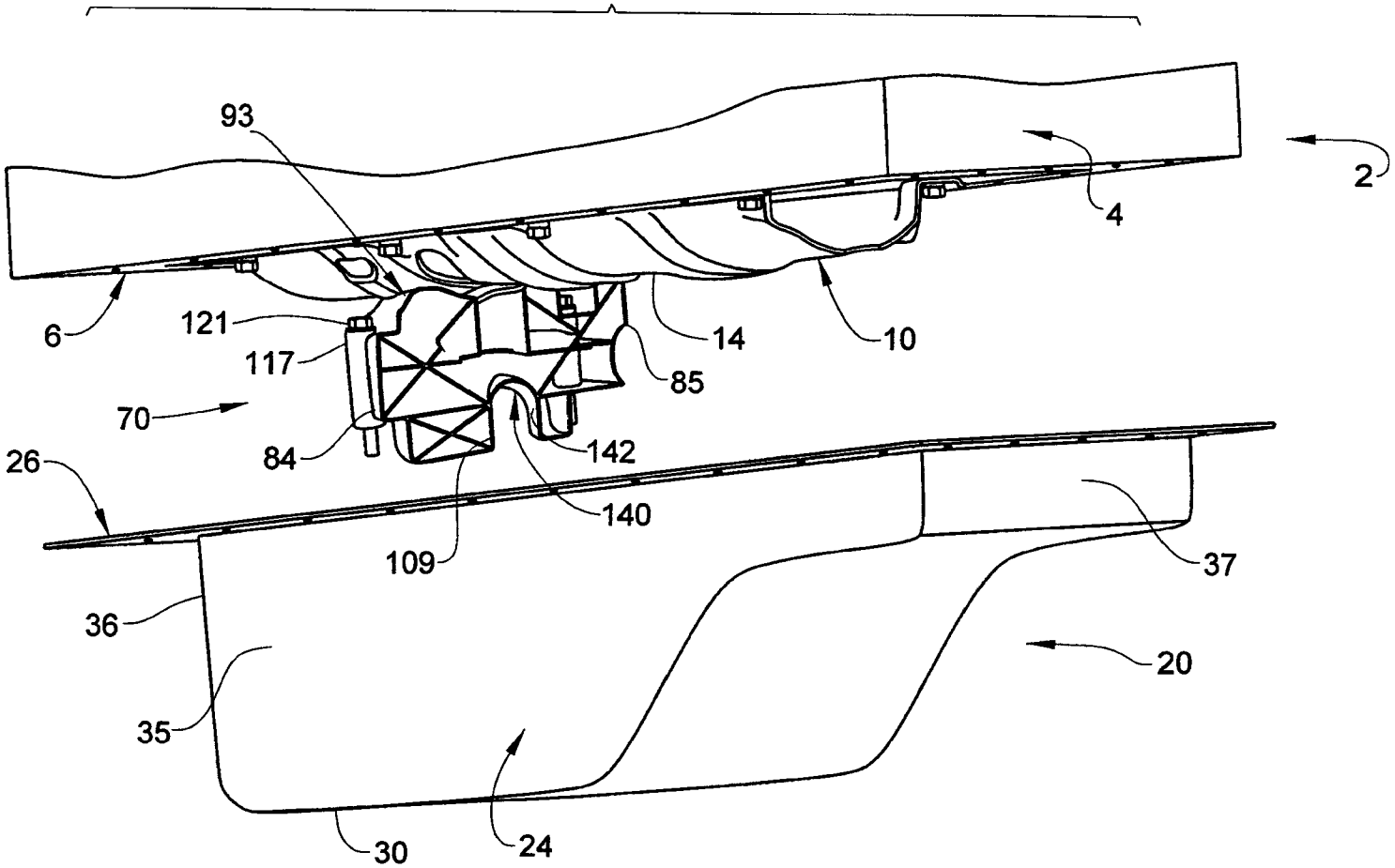
FIG. 1 is a partially disassembled perspective view of a motor vehicle engine including an oil pan having a vertically disposed oil pan baffle in accordance with an exemplary embodiment.

The following description is merely exemplary in nature and is not intended to limit the present disclosure, its application or uses. It should be understood that throughout the drawings, corresponding reference numerals indicate like or corresponding parts and features. A motor vehicle engine, in accordance with an exemplary embodiment, is indicated generally at 2 in FIG. 1. Motor vehicle engine 2 includes a bottom end 4 having a peripheral mounting flange 6. Peripheral mounting flange 6 surrounds connecting rod end portions (not shown). An oil deflector 10 covers the connecting rod end portions and is also surrounded by peripheral mounting flange 6. Oil deflector 10 includes a complex curvilinear surface profile 14 that guides oil into an oil pan 20. Oil pan 20 includes an oil pan body 24 having a peripheral rim 26 that mounts to peripheral mounting flange 6 through a plurality of mechanical fasteners, one of which is indicated at 28 in FIG. 2.

Figure 2:
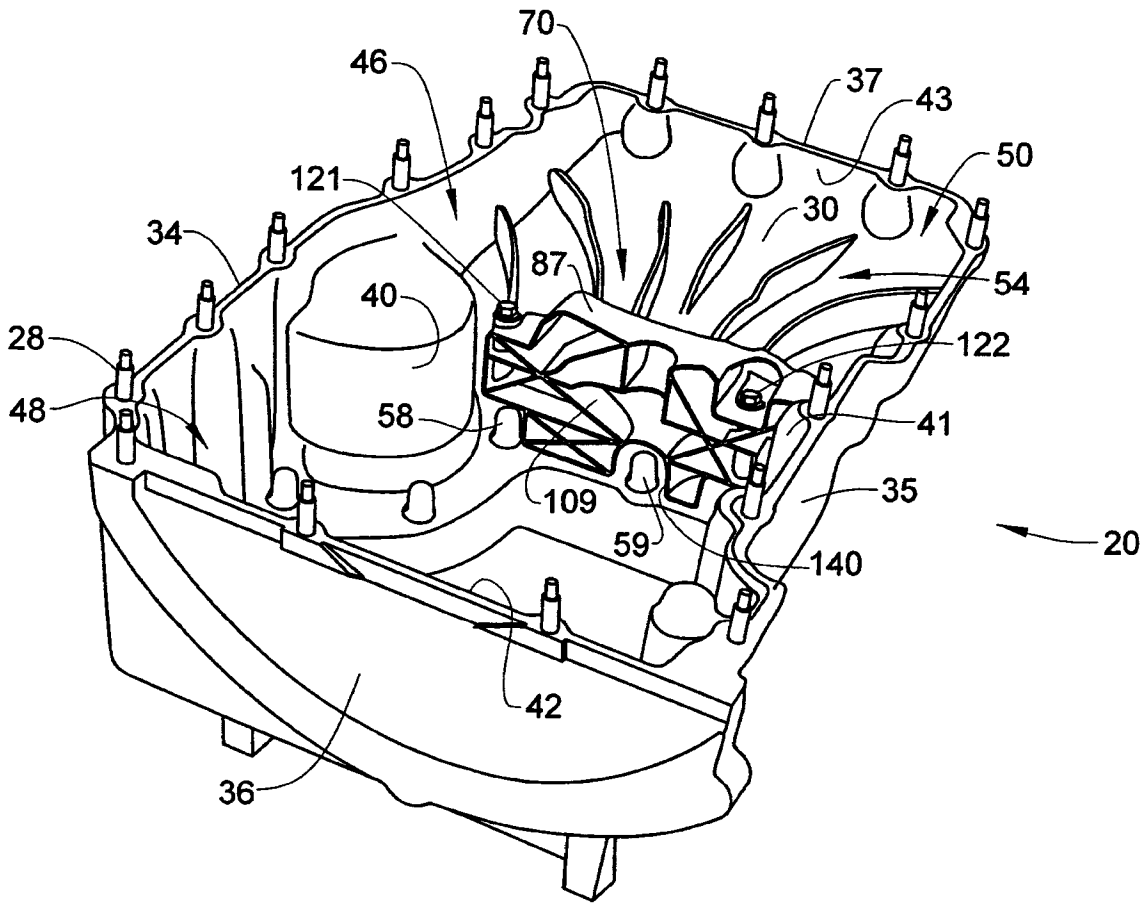
FIG. 2 is a perspective view of the vertically disposed oil pan baffle mounted in the oil pan in accordance with an exemplary embodiment
Figure 5:
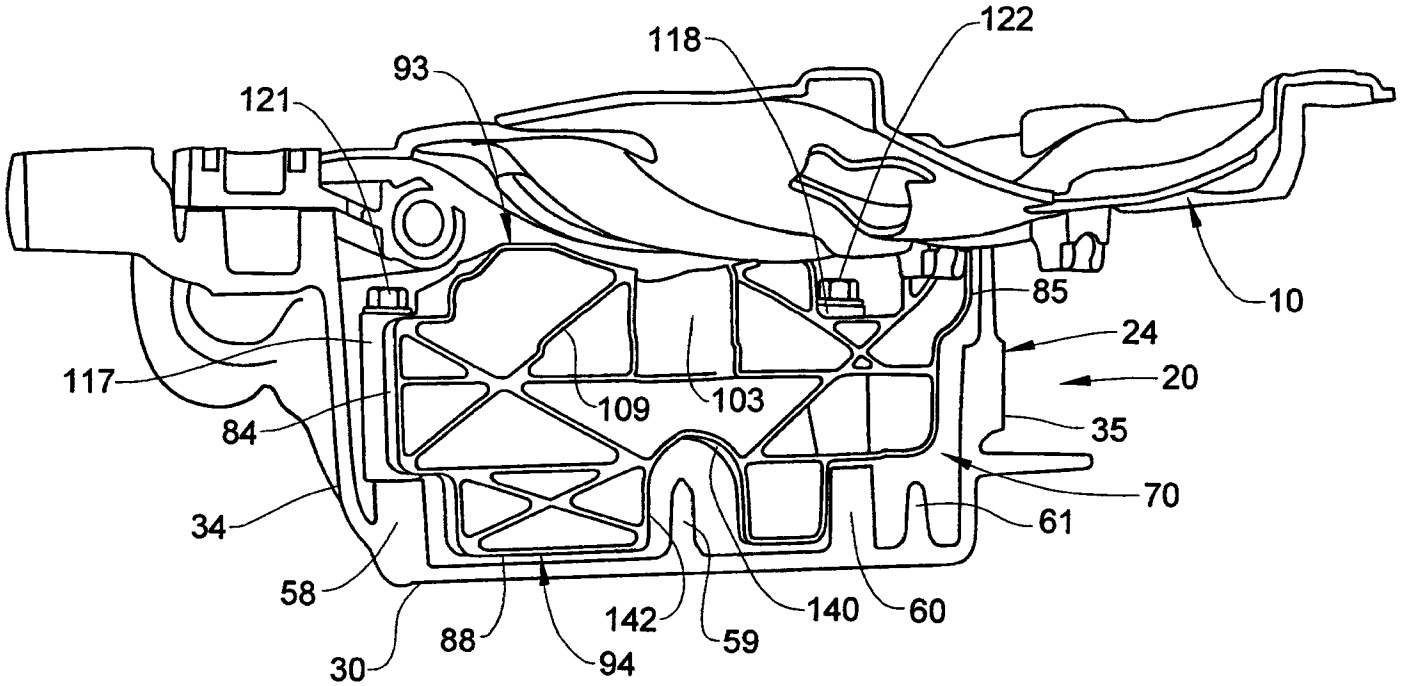
FIG. 5 is a cross-sectional end view of the vertically disposed oil pan baffle mounted in an oil pan in accordance with an exemplary embodiment.

In accordance with an exemplary embodiment illustrated in FIG. 2, oil pan body 24 includes a bottom wall 30, a first side wall portion 34, a second side wall portion 35, a third side wall portion 36 and a fourth side wall portion 37. First side wall portion 34 includes a first internal surface 40, second side wall portion 35 includes a second internal surface 41, third side wall portion 36 includes a third internal surface 42 and fourth side wall portion 37 includes a fourth internal surface 43. First, second, third and fourth internal surfaces 40-43, together with bottom wall 30 define a reservoir 46. Reservoir 46 includes a sump portion 48 and a collection portion 50. Collection portion 50 receives oil falling into oil pan 20. Sump portion 48, in addition to receiving oil falling into oil pan 20, includes an oil pump inlet (not shown) coupled to an oil pump (also not shown) that directs oil upward through motor vehicle engine 2. Oil pan 20 may include a plurality of guide members 54 extending substantially perpendicularly from bottom wall 30. Guide members 54 direct oil from collection portion 50 toward sump portion 48. Oil pan 20 also includes a number of protuberances, three of which are indicated at 58, 59, 60 and 61 (FIG. 5). Protuberances 58-61 form channels (not separately labeled) along bottom wall 30. In addition, protuberances 58 and 60 act as mounting structure, as will be detailed more fully below.

Figure 3:
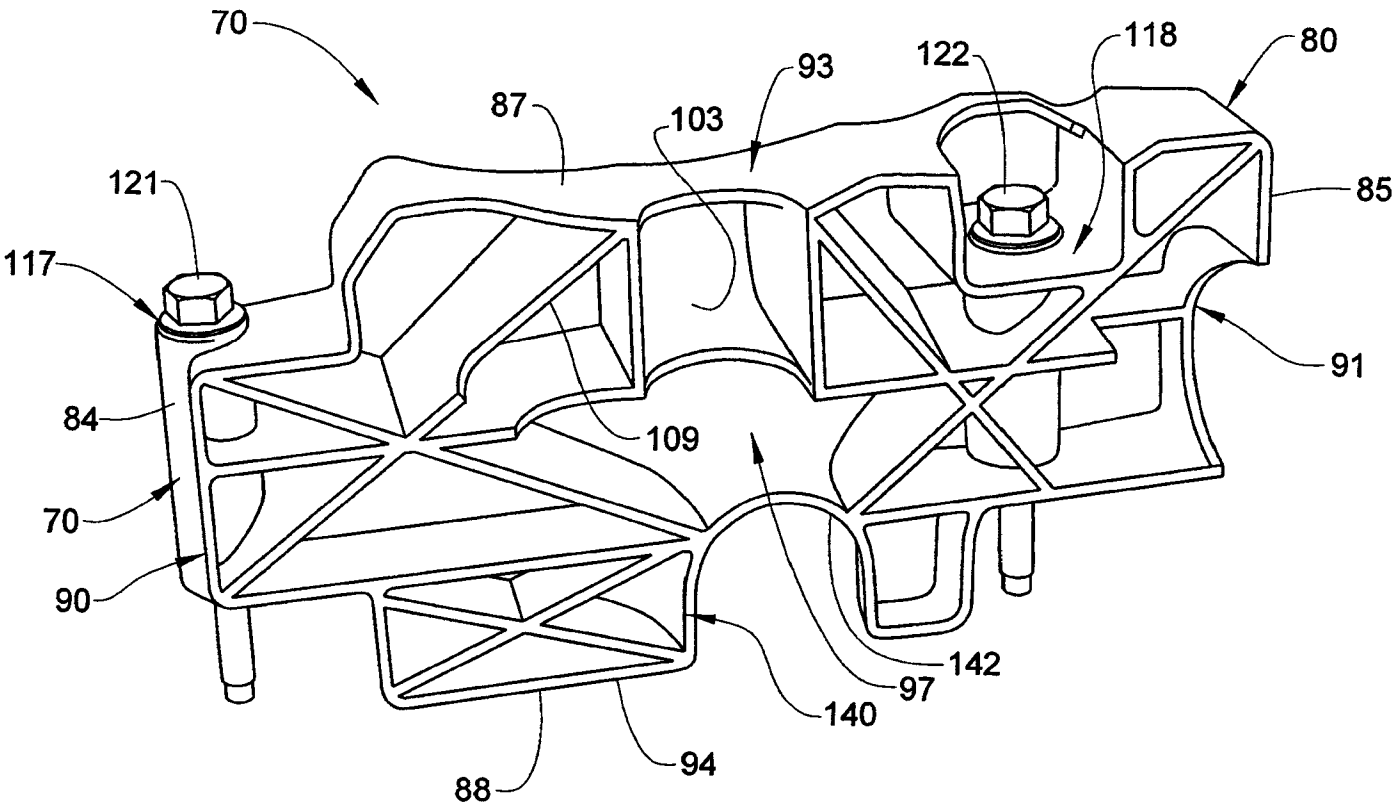
FIG. 3 is a perspective view of a first side of the vertically disposed oil pan baffle of FIG. 1.
Figure 4:
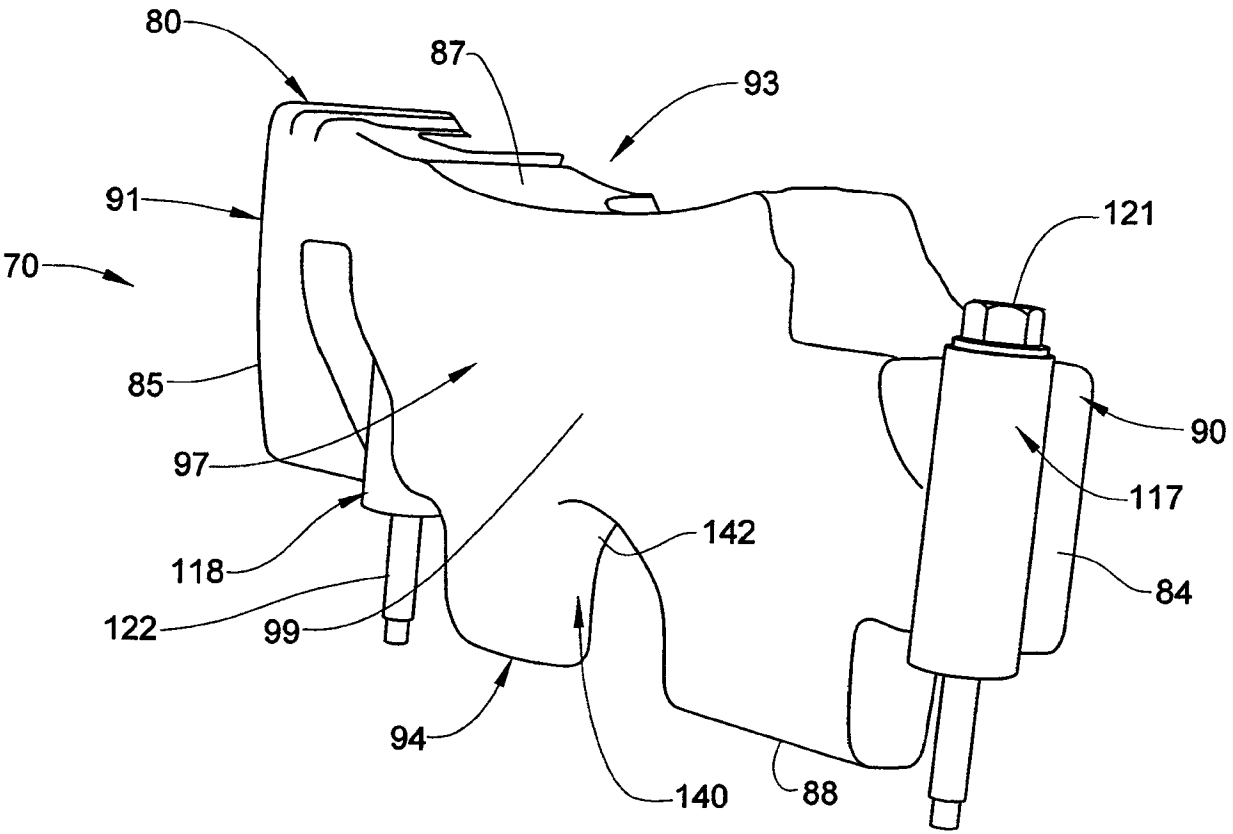
FIG. 4 is a perspective view of a second side of the vertically disposed oil pan baffle of FIG. 1

In further accordance with the exemplary embodiment, motor vehicle engine 2 includes a vertically disposed oil pan baffle 70 that divides sump portion 48 and collection portion 50. As best shown in FIGS. 3-5, vertically disposed oil pan baffle 70 includes a baffle body 80 having a first side wall 84 and an opposing, second side wall 85 that are joined by a third or top wall 87 and an opposing fourth or lower bottom wall 88. First side wall 84 includes a first contour 90 that generally conforms to first internal surface 40. Similarly, second side wall 85 includes a second contour 91 that generally conforms to second internal surface 41. In this manner, when vertically disposed oil pan baffle 70 is installed in oil pan 20, first and second side walls 84 and 85 are positioned substantially against first and second side wall portions 34 and 35. The term "substantially against" should be understood to mean that a gap of no more than 3 mm exists between first side wall 84 and first internal surface 40 and between second side wall 85 and second internal surface 41. In addition, third wall 87 includes a third contour 93 and fourth wall 88 includes a fourth contour 94. Third contour 93 is a complex curvilinear surface that generally corresponds to complex curvilinear surface profile 14 of oil deflector 10. Fourth contour surface 94 generally conforms to bottom wall 30.

In still further accordance with the exemplary embodiment, vertically disposed oil pan baffle 70 includes a vertically disposed surface 97 including a first or contoured side 99 and a second, oil retention side 103. First side 99 is exposed to oil in collection portion 50 while oil retention side 103 is exposed to oil in sump portion 48. Oil retention side 103 includes a plurality of lattice members 109 that collect oil moving away from sump portion 48. In this manner, oil retention side 103 captures a volume of oil during vehicle accelerations to maintain a desired oil supply at sump portion 48. Vertically disposed oil pan baffle 70 also includes a first mounting section 117 and a second mounting section 118. First mounting section 117 includes a first passage (not shown) that extends adjacent, and generally parallel to, first side wall 84. Second mounting section 118 includes a second passage (also not shown) that extends adjacent, and generally parallel to, second side wall 85. First and second mounting sections 117 and 118 receive mechanical fasteners 121 and 122 that join vertically disposed oil pan baffle 70 to oil pan 20 through protuberances 58 and 60.

In yet further accordance with the exemplary embodiment, vertically disposed oil pan baffle 70 includes a metering opening 140 that takes the form of a "mouse hole" 142 extending into vertically disposed surface 97 from fourth wall 88. Metering opening 140 is positioned over protuberance 59 and is sized and shaped to guide oil at a desired rate from collection portion 50 to sump portion 48. Vertically disposed oil pan baffle 70 forms a dam in oil pan 20 with metering opening 140 ensuring a nearly constant flow of oil into sump portion 48. Metering opening 140 is also sized and shaped to resist oil flowing from sump portion 48 into collection portion 50 during vehicle accelerations. In this manner, vertically disposed oil pan baffle 70 ensures a constant supply of oil in sump portion 48.

Figure 6:
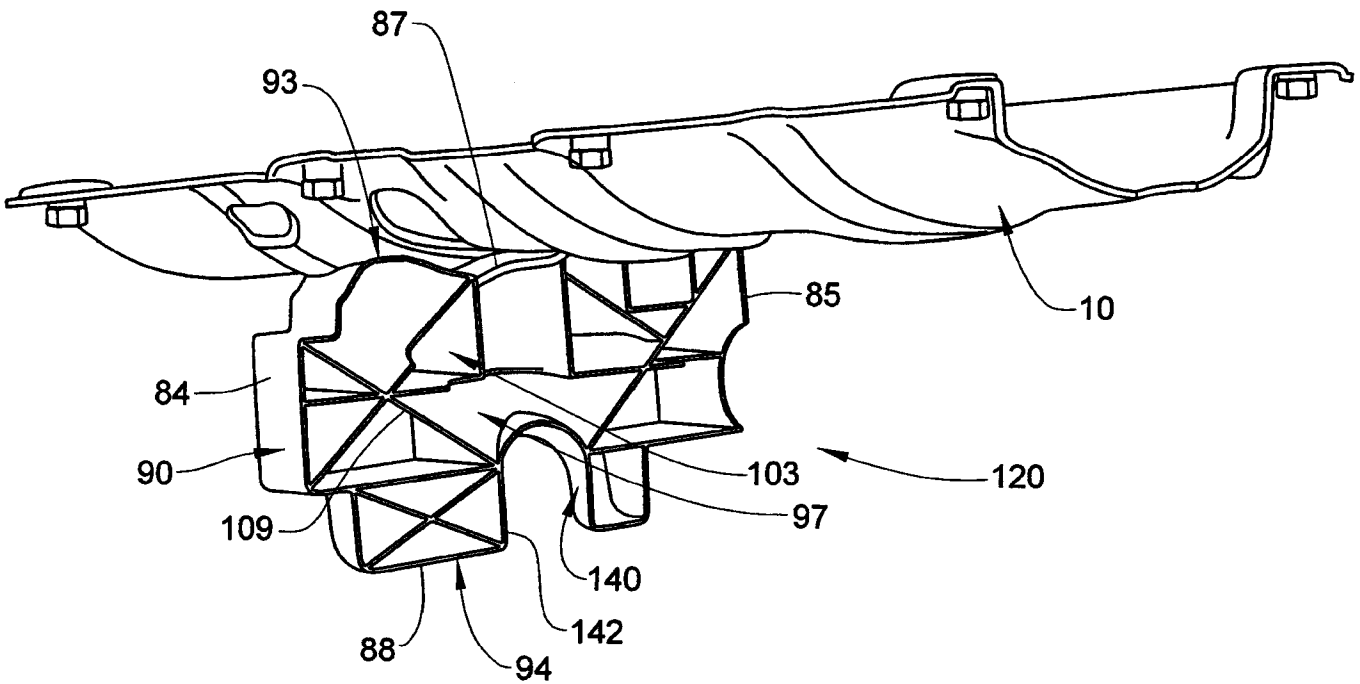
FIG. 6 is a perspective view of a vertically disposed oil pan baffle mounted to an oil deflector in accordance with another aspect of the exemplary embodiment.

At this point it should be understood that the exemplary embodiments describe an oil pan baffle that extends vertically within a vehicle oil pan. The vertically disposed oil pan baffle includes an opening that ensures a constant flow of oil to a sump portion of the oil pan. The vertically disposed oil pan baffle also resists oil flow from the sump portion during vehicle accelerations brought about by changes in speed, changes in direction and the like. Also, while described as being mounted to the oil pan itself, a vertically disposed oil pan baffle, in accordance with another aspect of the exemplary embodiment, may be supported by the oil deflector as shown in FIG. 6, wherein like reference numbers represent corresponding parts in the respective views.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. A vertically disposed oil pan baffle comprising:

a body having first and second opposing side walls joined by a third wall and an opposing fourth wall, each of the first and second side walls being configured to generally conform to first and second internal surfaces of an oil pan, the first side wall including a first mounting section and the second side wall including a second mounting section, each of the first and second mounting sections constitute passages extending through the body at corresponding ones of the first and second side walls; and a metering opening formed in one of the third and fourth walls, the metering opening being configured and disposed to control a rate of flow of oil through the vertically disposed oil pan baffle.

2. The vertically disposed oil pan baffle according to claim 1, further comprising: a surface extending between the first and second side walls, third wall and fourth wall.

3. The vertically disposed oil pan baffle according to claim 2, wherein the surface includes a first, contoured side and a second, oil retention side.

4. The vertically disposed oil pan baffle according to claim 3, wherein the body includes a plurality of lattice members extending from the second, oil retention side.

5. The vertically disposed oil pan baffle according to claim 4, wherein the plurality of lattice members extend substantially perpendicularly from the second, oil retention side.

6. The vertically disposed oil pan baffle according to claim 4, wherein the plurality of baffles are configured and disposed to retain a volume of oil during vehicle accelerations.

7. The vertically disposed oil pan baffle according to claim 1, wherein the other of the third and fourth walls includes a complex curvilinear surface profile.

8. The vertically disposed oil pan baffle according to claim 7, wherein the complex curvilinear surface profile generally corresponds to a surface profile of an oil deflector mounted to a motor vehicle engine.

9. A motor vehicle engine comprising:

an engine block having a bottom end including a peripheral mounting flange;

an oil deflector mounted to the bottom end and surrounded by the peripheral mounting flange;

an oil pan mounted to the engine block through the peripheral mounting flange, the oil pan including a bottom wall, and first, second, third and fourth side wall portions that define a sump portion and a collection portion, each of the first and second side walls including corresponding first and second internal surfaces; and a vertically disposed oil pan baffle positioned in the oil pan dividing the sump portion and the collection portion, the vertically disposed oil pan baffle comprising:

a body having first and second opposing side walls joined by a third wall and an opposing fourth wall, each of the first and second side walls being arranged adjacent to, and configured to, generally conform to the first and second internal surfaces of the first and second side walls of the oil pan, the first side wall including a first mounting section and the second side wall including a second mounting section, each of the first and second mounting sections constitute passages extending through the body at corresponding ones of the first and second side walls; and a metering opening formed in one of the third and fourth walls, the metering opening being configured and disposed to control a rate of flow of oil from the collection portion to the sump portion through the vertically disposed oil pan baffle.

10. The motor vehicle engine according to claim 9, wherein the vertically disposed oil pan baffle includes a surface extending between the first and second side walls, third wall and fourth wall.

11. The motor vehicle engine according to claim 10, wherein the surface includes a first, or contoured side and a second, oil retention side.

12. The motor vehicle engine according to claim 11, wherein the body includes a plurality of lattice members extending from the second, oil retention side.

13. The motor vehicle engine according to claim 12, wherein the plurality of lattice members is configured and disposed to retain a volume of oil during vehicle accelerations.

14. The motor vehicle engine according to claim 9, wherein the vertically disposed oil pan baffle is mounted to the oil pan.

15. The motor vehicle engine according to claim 9, wherein the vertically disposed oil pan baffle is mounted to the oil deflector.

16. The motor vehicle engine according to claim 15, wherein the other of the third and fourth walls of the vertically disposed oil pan baffle includes a complex curvilinear profile that generally conforms to a surface profile of the oil deflector.

17. The motor vehicle engine according to claim 9, wherein the oil pan includes a plurality of guide members extending substantially perpendicularly from the bottom wall in the collection portion, the guide members being shaped to guide oil in the collection portion toward the metering opening.

18. The motor vehicle engine according to claim 9, wherein the oil pan includes a plurality of protuberances, the vertically disposed oil pan baffle being mounted to at least one of the plurality of protuberances.

* * * * *